US009541312B2

(12) United States Patent
Woolley et al.

(10) Patent No.: US 9,541,312 B2
(45) Date of Patent: Jan. 10, 2017

(54) PASSIVE OIL LEVEL LIMITER

(75) Inventors: Lance D. Woolley, Glastonbury, CT (US); Peter S. Matteson, South Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 1548 days.

(21) Appl. No.: 12/991,288

(22) PCT Filed: May 7, 2008

(86) PCT No.: PCT/US2008/062878

§ 371 (c)(1),
(2), (4) Date: Nov. 5, 2010

(87) PCT Pub. No.: WO2009/136919

PCT Pub. Date: Nov. 12, 2009

(65) Prior Publication Data

US 2011/0120154 A1 May 26, 2011

(51) Int. Cl.

| | |
|---|---|
| ***F01K 9/00*** | (2006.01) |
| ***F25B 31/00*** | (2006.01) |
| ***F01D 25/20*** | (2006.01) |

(52) U.S. Cl.

CPC ..... *F25B 31/004* (2013.01); *F01D 25/20* (2013.01); *F25B 2700/03* (2013.01)

(58) Field of Classification Search

CPC ..... F01D 25/20; F25B 2700/03; F25B 31/004; F25B 31/002; F16N 19/006; F16N 2270/10; F16N 2270/14; F01K 9/00

USPC ..... 62/84, 192, 193, 468, 470, 475

See application file for complete search history.

(56) References Cited

U.S. PATENT DOCUMENTS

| | | | | |
|---|---|---|---|---|
| 2,792,912 | A | | 5/1957 | Kangas |
| 3,632,235 | A | * | 1/1972 | Grenci ..... 417/439 |
| 4,467,646 | A | * | 8/1984 | Berryman et al. ..... 73/304 C |
| 4,478,050 | A | * | 10/1984 | DiCarlo ..... F04B 39/16 62/193 |
| 4,503,685 | A | * | 3/1985 | DiCarlo ..... F04B 39/16 62/193 |
| 4,530,215 | A | * | 7/1985 | Kramer ..... F25B 31/002 62/468 |

(Continued)

FOREIGN PATENT DOCUMENTS

| | | | |
|---|---|---|---|
| JP | 5126419 | A | 5/1993 |
| JP | H05280322 | A | 10/1993 |
| JP | 2005106039 | A | 4/2005 |

OTHER PUBLICATIONS

International Search Report and Written Opinion mailed Jan. 6, 2009 (11 pgs.).

(Continued)

*Primary Examiner* — Frantz Jules
*Assistant Examiner* — Martha Tadesse
(74) *Attorney, Agent, or Firm* — Carlson, Gaskey & Olds, PC

(57) ABSTRACT

A vapor expansion/compression system having an oil sump for lubrication of the turbine/compressor bearings includes an oil and/or vapor vent line leading from a strategic location in the oil sump to the condenser such that the oil level in the sump is limited to the predetermined level, and any excess oil is pumped from the sump to thereby prevent the oil level from reaching a level at which bearings failure could be caused due to a high oil level.

9 Claims, 3 Drawing Sheets

(56) References Cited

U.S. PATENT DOCUMENTS 4,551,989 A * 11/1985 Lindahl ..... F04B 39/0246 417/428
4,573,327 A 3/1986 Cochran
4,748,820 A * 6/1988 Shaw ..... F25B 1/10 62/175
5,321,956 A * 6/1994 Kemp ..... F25B 31/002 62/193
5,327,997 A 7/1994 Nash, Jr. et al.
5,586,450 A * 12/1996 Tollar ..... F04B 39/0207 62/192
5,901,559 A * 5/1999 Westermeyer ..... G01F 23/74 417/12
5,911,289 A * 6/1999 Waller ..... F16N 19/006 184/103.2
6,481,973 B1 11/2002 Struthers
6,687,122 B2 * 2/2004 Monfarad ..... 361/679.54
6,941,767 B2 * 9/2005 Matsuoka ..... F25B 31/004 62/470
6,986,259 B2 * 1/2006 Takegami ..... F25B 13/00 62/192
7,082,774 B2 * 8/2006 Ayub ..... 62/84
7,117,691 B2 * 10/2006 Taniguchi ..... F01K 9/00 60/531
7,174,716 B2 2/2007 Brasz et al.
7,222,491 B2 * 5/2007 Moriwaki ..... F04B 39/0207 62/117
7,231,783 B2 * 6/2007 Esslinger ..... F25B 31/004 62/468
2004/0144093 A1 * 7/2004 Hanna et al. ..... 60/651
2005/0072182 A1 * 4/2005 Taniguchi et al. ..... 62/467
2006/0042307 A1 3/2006 Esslinger et al.
2010/0186410 A1 * 7/2010 Cogswell ..... F01K 25/10 60/671

OTHER PUBLICATIONS

International Preliminary Report on Patentability mailed Nov. 18, 2010 (6 pgs.).
Supplementary European Search Report for European Application No. 08747774.1 completed on Jul. 21, 2014.

* cited by examiner

PASSIVE OIL LEVEL LIMITER

TECHNICAL FIELD

This invention relates generally to refrigerant expansion systems and, more particularly, to a method and apparatus for preventing bearing failures caused by high oil levels in the turbine sump.

BACKGROUND OF THE DISCLOSURE

In closed circuit refrigerant expansion systems such as in an organic rankine cycle (ORC) system, lubrication of the moving parts of the turbine is necessary to ensure continuous and prolong periods of operation. For that purpose, the turbine is provided with an oil accumulator or sump that is intended to have a minimum level of oil contained therein at all times to provide an oil source for properly lubricating the turbine parts.

In such a system, it is recognized that a certain amount of the lubricating oil becomes entrained within the working fluid or refrigerant that is circulated throughout the system. In order that the oil is returned to the oil sump, an oil separator is commonly provided such that the oil entrained refrigerant passes through the separator, with the separated oil being returned to the sump and the separated refrigerant being passed back into the primary working fluid circuit.

From time to time, as part of normal and regular maintenance, it is necessary to change or add oil to the sump. It is possible that, when a technician checks the level of the oil in the sump, it appears to be low because substantial amounts of the oil may not have been returned to the sump from the remaining portion of the system due to a recent operating event such as a rapid shutdown. If the technician then adds oil to bring the level of the sump up to a level which he believes is acceptable, then, when the oil in the system is returned to the sump, it will raise the level to an unacceptably high level so as to exceed the safe operating level and come in direct contact with the bearings. This, in turn, may cause the bearings to "skid" and to fail.

What is needed is a method and apparatus for preventing a rise in the oil level of the sump to a level that presents a danger to the bearings.

DISCLOSURE

In accordance with one aspect of the disclosure, provision is made for sensing the level of the oil in the turbine sump and when it reaches a predetermined threshold level, it is caused to be pumped out of the sump until it reaches a reduced predetermined acceptable level.

DETAILED DESCRIPTION OF THE DISCLOSURE

Figure 1:
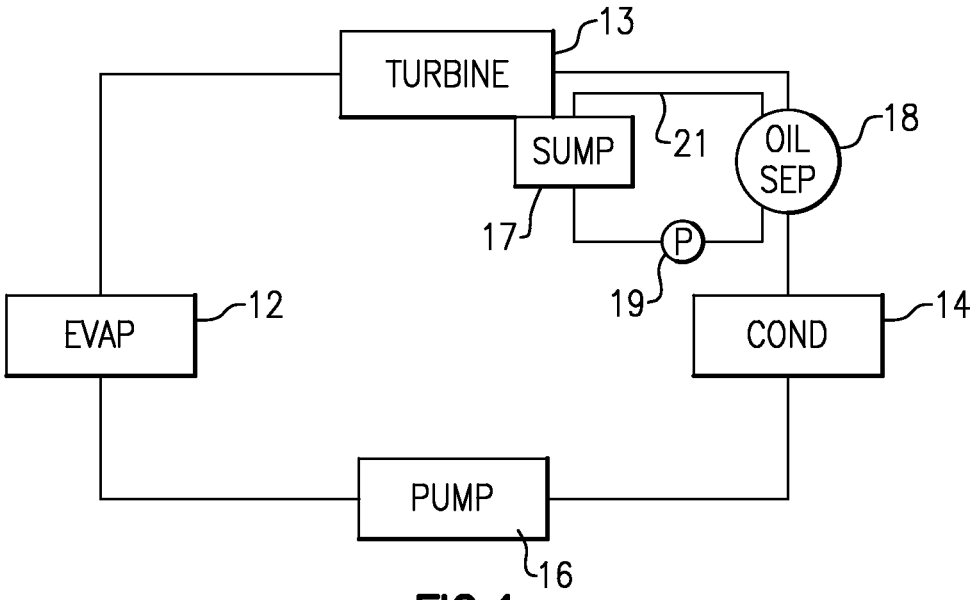
FIG.1 Prior Art
FIG. 1 is a schematic illustration of a typical prior art organic rankine cycle system.

FIG. 1 shows a typical vapor expansion system, such as an organic rankine cycle (ORC) system, in accordance with the prior art. An evaporator provides hot, high pressure vapor to a turbine 13, which converts the energy to kinetic energy, with the lower pressure, lower temperature vapor then passing to a condenser 14, with the resultant liquid then being pumped by a pump 16 back to the evaporator 12.

The turbine 13 is bearing mounted, and the bearings require a lubricant which is provided to the turbine 13 by way of an attached accumulator or sump 17. In the process of lubrication of the turbine bearings, some of the lubricant becomes entrained in the vapor passing from the turbine 13. Accordingly, an oil separator 18 is provided to separate the oil from the vapor, with the vapor then passing on to the condenser 14 and the separated oil being passed to the sump 17 by way of a pump 19. One form of pump that may be used is an eductor which operates on the basis of high pressure refrigerant from the evaporator.

Although the pump 19 is provided to transfer liquid oil from the oil separator 18 to the sump 17, it is likely that the vapor will also be passed to the sump 17, especially if an eductor is used for the purpose of pumping. Accordingly, a vent line 21 is normally provided from an upper portion of the sump 17 to the oil separator 18 such that any vapor in the sump 17, which is at a higher pressure than the oil separator 18, will pass along the vent line 21 and return to the working fluid main path.

Figure 2:
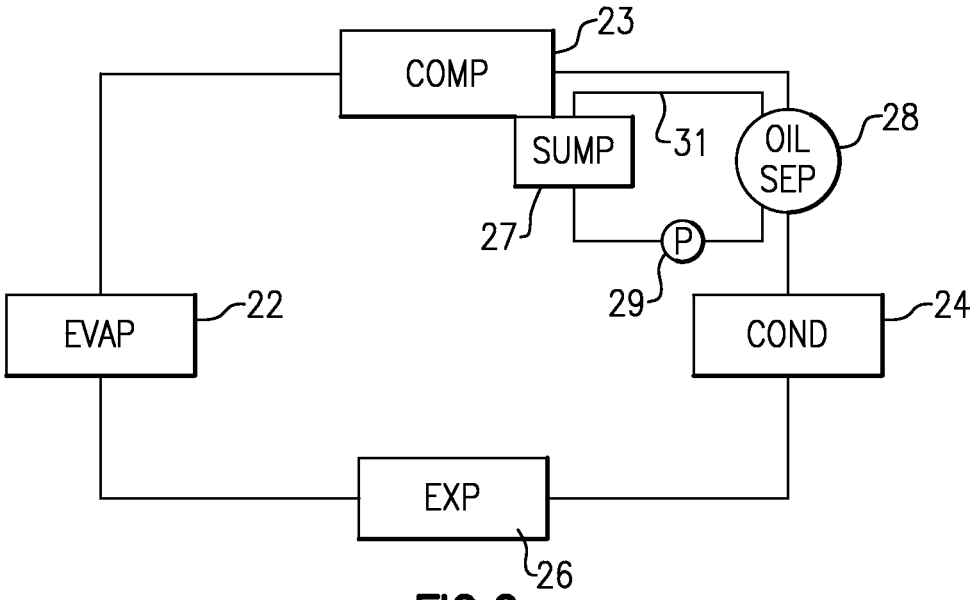
FIG.2 Prior Art
FIG. 2 is a typical prior art vapor compression system.

A vapor compression system, which is shown generally in FIG. 2, is similar to the vapor expansion system as set forth above and includes an evaporator 22, a compressor 23, a condenser 24 and an expansion device 26. Here, the evaporator 22 passes low pressure vapor to a compressor 23, with the resultant high pressure vapor then passing to the condenser 24. Liquid refrigerant is then passed to the expansion device 26 for an expansion of the liquid/vapor mixture to the evaporator 22.

Similar to the vapor expansion system described hereinabove, the vapor compression system has a sump 27 for the lubrication of the bearings in the compressor 23, an oil separator 28, a pump 29 and a vent line 31.

Figure 3:
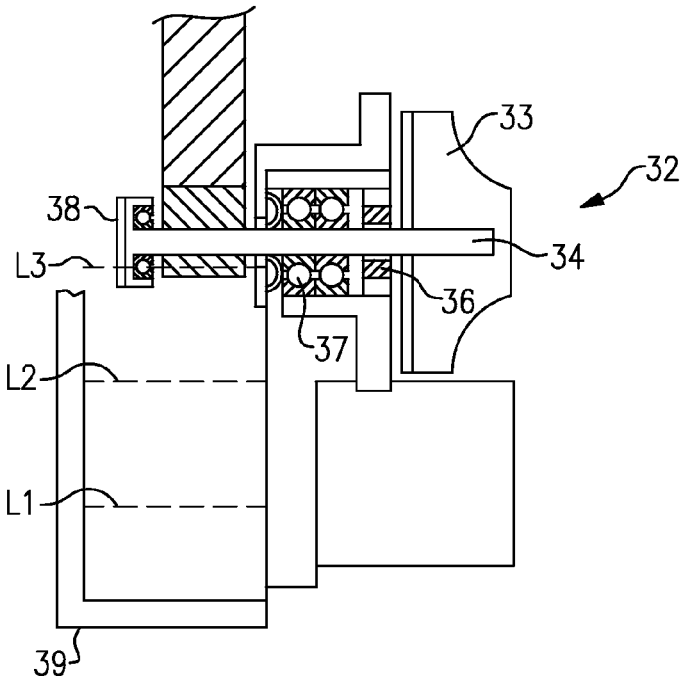
FIG.3 Prior Art
FIG. 3 is a partial sectional view of the bearing portion of a turbine/compressor in accordance with the prior art.

Referring now to FIG. 3, the rotating machinery, which may be either the turbine or the compressor, is shown generally at 32 has including a rotor 33 mounted on the shaft 34 which, in turn, is rotatably supported by way of bearings 36, 37 and 38. A sump 39 is mounted below the bearings for the purpose of lubricating those bearings.

In order that sufficient oil is available for delivery to the bearings, a minimum oil level, $L_1$ is established. Thus, during operation, the oil level should be at least at that level. An ideal or preferred level is shown at $L_2$. Finally, a third level, or a high level, is shown at $L_3$ wherein the oil is above the lowest portion of the bearing 38 such that an excess of oil is provided to the bearings so as thereby possibly provide a skid and then eventually result in bearing failure. It is therefore desirable to determine when the oil level exceeds the ideal level $L_2$ and to prevent its reaching the high level of $L_3$.

Figure 4:
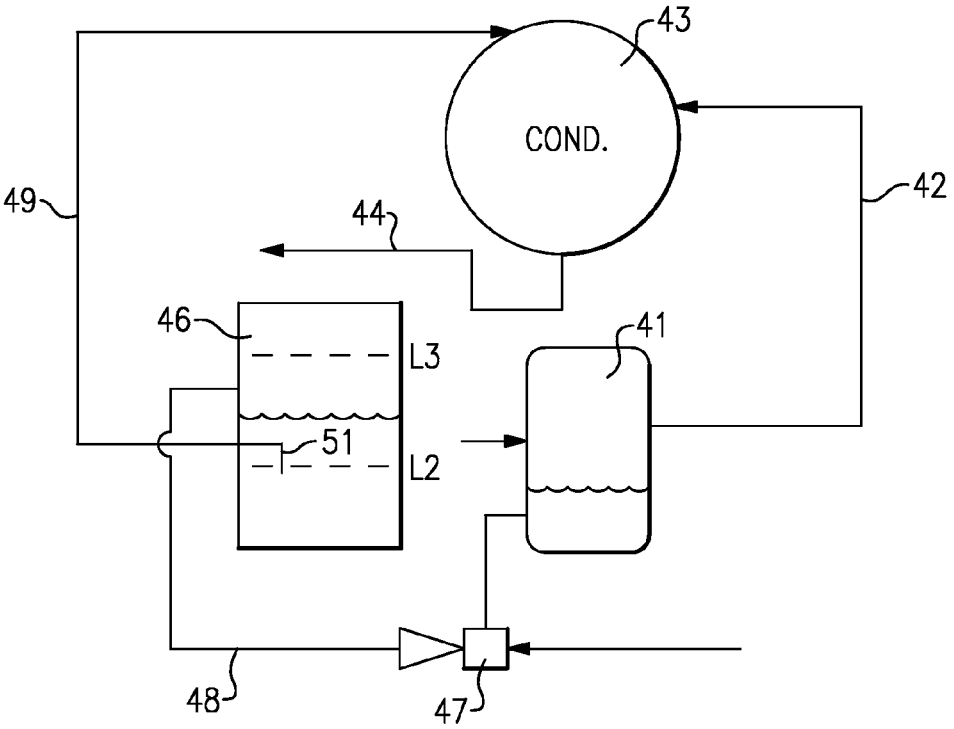
FIG. 4 is a schematic illustration of a portion of a vapor expansion/compression system in accordance with present invention.

Referring now to FIG. 4, there is shown an oil separator 41 which receives flow from either the turbine or the compressor as described hereinabove and passes vapor along line 42 to the condenser 43, with the condensate then passing along line 44 to either the pump, in the case of the expansion system or the expansion device, in the case of the vapor compression system. The sump 46 is attached to either the turbine 13 or the compressor 23 in the manner described hereinabove. Again, an eductor 47 causes lubricant to be pumped from the oil separator 41 to the sump 46 along line 48.

Rather than the pressure vent 21 or 31 leading from the top of the sump 17 or 27 to the oil separator 18 or 28 as in the prior art embodiments of FIGS. 1 and 2, an oil/vapor vent line 49 is connected from a strategic location within the sump 46 to the condenser 43. That is, the oil/vapor vent line has its one end 51 placed within the accumulator 46 at a level which is at the level L2 and below the level $L_3$ at which problems would arise as discussed hereinabove. Thus, as the level of the lubricant in the sump 46 rises to the ideal level $L_2$ and reaches the level of the one end 51, the higher pressure in the accumulator 46, as compared with that of the condenser 43, causes the oil to flow from the sump 46 to the condenser 43. In this way, the oil level is controlled to maximum of level L2 and prevented from substantially exceeding the level $L_2$, such that it will never reach the level $L_3$ to cause the problems as discussed hereinabove.

During periods of operation in which the oil level is below the one end of the oil/vapor vent line, refrigerant vapor will be caused by the higher pressure in the sump 46 to flow to the condenser 43 in the same manner as described hereinabove with respect to the prior art.

Figure 5:
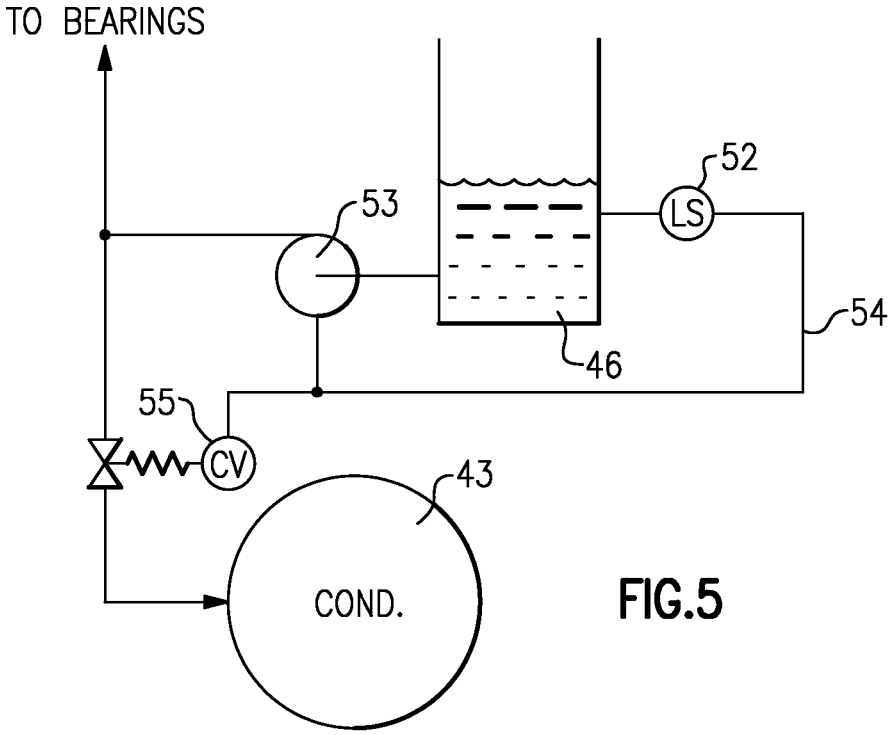
FIG. 5 is a modified embodiment thereof.

An alternative embodiment is shown in FIG. 5 wherein, a level sensor 52 is installed to sense the level of lubricant in the sump 46 and to responsively activate by line 54 the pump 19 and/or a control valve (55) in order to pump the excess lubricant to the condenser 43. In such a control valve configuration, where an existing pump 19 used to lubricate the bearings has excess capacity, oil can be evacuated from the oil sump 46 using existing hardware and only the addition of a control valve 55 to redirect a small portion of the oil flow. On the other hand if the pump is unique for this purpose the pump 19 would only be active during periods in which the level sensor 52 indicates that the level of the lubricant in the accumulator 46 is above a desired level.

Figure 6:
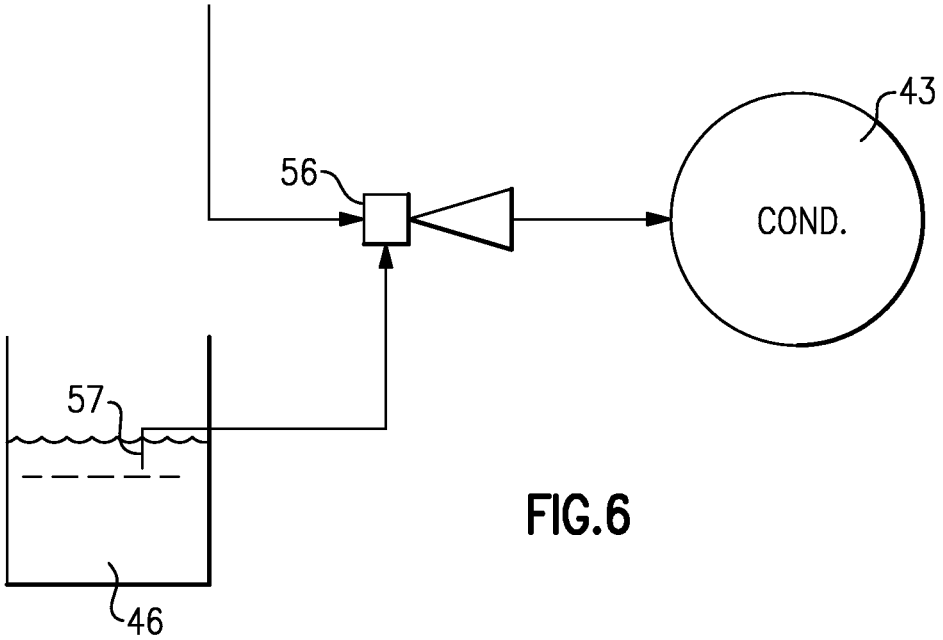
FIG. 6 is another modified embodiment thereof.

Another embodiment is shown in FIG. 6 wherein, rather then a pump, an eductor 56 is connected to a dip tube 57 strategically located within the accumulator 46 in order to pump out any excess oil when it reaches the level of the dip tube 57. In this case, high pressure refrigerant is being supplied to the eductor 56 such that it is operating at all times, even when the lubricant level is below the level of the tip tube 57, such that only vapor would be pumped to the condenser 43. However, the use of a more expensive control valve and its associated power consumption as shown in FIG. 5 is avoided and a passive mechanical system provides protection whenever the equipment is operating.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A method of preventing the lubricant level in a turbine/compressor sump of a vapor expansion/compressor system from reaching a high level sufficient to cause a mechanical failure in the turbine/compressor rotating equipment including bearings, comprising the steps of:

providing a pumped path out of the sump so that the lubricant can be removed from the oil sump at a pre-determined threshold level providing a passive or active response that causes oil removal through this path when the lubricant level reaches the pre-determined level in the sump determining when the level of lubricant in the sump reaches a predetermined threshold level which is above a minimum required level and below the high level;

responsively causing lubricant to be pumped out of the sump so that the lubricant level does not substantially exceed said predetermined threshold level; and said lubricant is pumped out of the sump and into a condenser.

2. The method as set forth in claim 1 wherein said vapor expansion/compression system includes an oil vent tube extending from said sump to said condenser, with said oil vent extending into said sump with an open end disposed at said acceptable level, and with the pressure in said sump being greater than in said condenser such that when the oil level in the sump is above the oil vent open end, it will be caused to flow through the oil vent to the condenser.

3. The method as set forth in claim 1 wherein said vapor expansion/compression system includes a pump and a level sensor with said pump being in fluid communication between said sump and said condenser, and said level sensor being operative to sense the lubricant level in said sump and further wherein said level sensor responsively causes said pump to cause the oil to be pumped out of the sump.

4. The method as set forth in claim 1 wherein said vapor expansion/compression system includes an educator and a dip tube, with said educator being fluidly interconnected between said oil sump and said condenser and said dip tube being disposed in said oil sump at said acceptable level, such that when the oil level is above said dip tube, said educator causes the oil to be pumped out of the sump.

5. The method as set forth in claim 1 wherein said oil/vapor vent line has an open end disposed at said predetermined level within the sump and further wherein the pressure in the sump is greater than the pressure in the condenser so as to cause the flow of oil and/or working fluid from the sump to the condenser.

6. A closed loop vapor compression or expansion system of the type having an oil separator, a condenser and a compressor or turbine with bearings to be lubricated from an oil sump located below the bearings, comprising:

a pump for causing oil to flow from the oil separator to the oil sump;

an oil/vapor vent line fluidly communicating between the sump and the condenser; and a fluid flow causing system for causing oil to flow from the sump to the condenser by way of said oil/vapor vent line when a level of oil in the sump is above a predetermined level.

7. The closed loop vapor compression or expansion system as set forth in claim 6, wherein said oil/vapor vent line has an open end disposed at said predetermined level within the sump and further wherein the pressure in the sump is greater than the pressure in the condenser so as to cause the flow of oil from the sump to the condenser.

8. The closed loop vapor compression or expansion system as set forth in claim 6 and including a sensor for determining the level of oil in the sump and a pump for responsively pumping oil from the sump to the condenser when the oil level is above said predetermined level.

9. The closed loop vapor compression or expansion system as set forth in claim 6 wherein said fluid flow causing means comprises an educator.

* * * * *